US008568109B2

(12) United States Patent
Nathan et al.

(10) Patent No.: US 8,568,109 B2
(45) Date of Patent: Oct. 29, 2013

(54) PUMP FOR A HIGH-PRESSURE CLEANING DEVICE

(75) Inventors: Robert Nathan, Backnang (DE); Juergen Erdmann, Schorndorf-Weiler (DE)

(73) Assignee: Alfred Kaercher GmbH & Co. KG, Winnenden (DE)

( * ) Notice: Subject to any disclaimer, the term of this patent is extended or adjusted under 35 U.S.C. 154(b) by 0 days.

(21) Appl. No.: 13/425,495

(22) Filed: Mar. 21, 2012

(65) Prior Publication Data

US 2012/0213652 A1 Aug. 23, 2012

Related U.S. Application Data

(63) Continuation of application No. PCT/EP2010/064157, filed on Sep. 24, 2010.

(30) Foreign Application Priority Data

Oct. 1, 2009 (DE) ..... 10 2009 049 095

(51) Int. Cl.
*F04B 27/08* (2006.01)
*F04B 49/00* (2006.01)
*B05B 9/00* (2006.01)

(52) U.S. Cl.
USPC ..... 417/270; 417/300; 239/126

(58) Field of Classification Search
USPC ..... 417/270, 300; 239/124, 126, 127, 526, 239/570
See application file for complete search history.

(56) References Cited

U.S. PATENT DOCUMENTS

| | | | | | |
|---|---|---|---|---|---|
| 2,018,119 | A | * | 10/1935 | Brouse | 417/282 |
| 2,562,615 | A | * | 7/1951 | Huber | 417/289 |
| 2,806,430 | A | * | 9/1957 | Osborne | 137/115.07 |
| 3,362,335 | A | | 1/1968 | Stephens et al. | |
| 4,692,102 | A | | 9/1987 | Häfele et al. | |
| 4,784,368 | A | * | 11/1988 | Koch et al. | 251/51 |
| 5,259,556 | A | | 11/1993 | Paige et al. | |
| 5,397,054 | A | * | 3/1995 | Ziegs | 239/126 |
| 5,409,032 | A | | 4/1995 | Berfield | |
| 5,735,461 | A | * | 4/1998 | Winther | 239/124 |
| 5,950,669 | A | | 9/1999 | Fehlmann et al. | |
| 6,474,958 | B2 | * | 11/2002 | Nathan | 417/269 |

(Continued)

FOREIGN PATENT DOCUMENTS

| | | |
|---|---|---|
| CN | 2694014 | 4/2005 |
| DE | 27 05 585 | 8/1977 |

(Continued)

*Primary Examiner* — Charles Freay
(74) *Attorney, Agent, or Firm* — Lipsitz & McAllister, LLC

(57) ABSTRACT

A pump for a high-pressure cleaning device for delivering cleaning fluid is provided. The pump has at least one pump chamber, into which at least one piston plunges, and which is connected to a suction line via at least one inlet valve and to a pressure line via at least one outlet valve. A bypass line leads from the pressure line to the suction line. An overflow valve is arranged in the bypass line. The valve body of the overflow valve is connected to a control piston which is displaceably held in a control chamber with the interposition of a sealing element and moves the valve body into a closed or an open position as a function of the flow rate of the cleaning fluid in the pressure line. A sliding element is arranged in the control chamber and abuts sealingly on the wall of the control chamber.

11 Claims, 5 Drawing Sheets

(56) References Cited

U.S. PATENT DOCUMENTS

| | | | | |
|---|---|---|---|---|
| 6,497,247 | B1 | 12/2002 | Kinoshita et al. | |
| 6,866,483 | B2 * | 3/2005 | Pol | 417/43 |
| 2007/0267063 | A1 | 11/2007 | Davis | |
| 2010/0059603 | A1 | 3/2010 | Mueller et al. | |

FOREIGN PATENT DOCUMENTS

| | | |
|---|---|---|
| DE | 32 48 622 | 7/1984 |
| DE | 85 14 497 | 8/1985 |
| DE | 36 34 827 | 4/1988 |
| DE | 39 36 155 | 5/1991 |
| DE | 42 21 286 | 1/1993 |
| DE | 93 01 796 | 5/1993 |
| DE | 43 28 382 | 3/1994 |
| DE | 44 45 519 | 6/1996 |
| DE | 296 11 935 | 10/1996 |
| DE | 297 03 009 | 6/1997 |
| DE | 196 07 881 | 9/1997 |
| DE | 196 17 778 | 10/1997 |
| DE | 297 12 659 | 10/1997 |
| DE | 197 28 225 | 1/1999 |
| DE | 696 02 551 | 9/1999 |
| DE | 10 2007 017 970 | 10/2008 |
| DE | 10 2008 059 782 | 6/2009 |
| EP | 0 608 796 | 8/1994 |
| EP | 0 631 054 | 12/1994 |
| EP | 0 668 113 | 8/1995 |
| EP | 44 04 925 | 8/1995 |
| EP | 0 793 017 | 9/1997 |
| EP | 1 234 980 | 8/2002 |
| EP | 1 496 252 | 1/2005 |
| FR | 2 341 087 | 9/1977 |
| JP | 2006207833 | 8/2006 |

* cited by examiner

PUMP FOR A HIGH-PRESSURE CLEANING DEVICE

This application is a continuation of international application number PCT/EP2010/064157 filed on Sep. 24, 2010 and claims the benefit of German application number 10 2009 049 095.7 filed on Oct. 1, 2009.

The present disclosure relates to the subject matter disclosed in international application number PCT/EP2010/064157 of Sep. 24, 2010 and German application number 10 2009 049 095.7 of Oct. 1, 2009, which are incorporated herein by reference in their entirety and for all purposes.

BACKGROUND OF THE INVENTION

The invention relates to a pump for a high-pressure cleaning device for delivering a cleaning fluid, comprising at least one pump chamber, into which at least one piston plunges which can be moved back and forth and which is connected to a suction line via at least one inlet valve and to a pressure line via at least one outlet valve, and comprising a bypass line which leads from the pressure line to the suction line and in which an overflow valve is arranged, the valve body of which is connected to a control piston which is displaceably held in a control chamber with the interposition of a sealing element and which moves the valve body into a closed position or an open position as a function of the flow rate of the cleaning fluid in the pressure line, wherein the control piston divides the control chamber into a high pressure chamber which is connected to the pressure line upstream of a flow restriction point and a low pressure chamber which is connected to the pressure line downstream of the flow restriction point.

Pumps of this type are known from DE 196 07 881 A1. They can be used to subject a cleaning fluid, for example water, to pressure and to subsequently direct it at an object via, for example, a pressure hose which can be connected to the pressure line and a nozzle head which is arranged at the free end of the pressure hose. So that the mechanical load on the pump as well as heat losses can be reduced, the cleaning fluid delivered by the pump is guided in a circuit with as little flow resistance as possible when the nozzle head is closed, i.e. it will be returned from the pressure line to the suction line again so that the pressure in the pressure line sinks. For this purpose, the pressure line is connected to the suction line via a bypass line and an overflow valve is arranged in the bypass line. During working operation of the pump, i.e. when the nozzle head is open, the overflow valve closes the flow connection between the pressure line and the suction line. If the nozzle head is closed, the overflow valve will release the flow connection between the pressure line and the suction line so that the pressure prevailing in the pressure line is reduced. The valve body of the overflow valve is connected for this purpose to a control piston which moves the valve body into a closed position or an open position as a function of the flow rate of the cleaning fluid in the pressure line. The flow rate of the cleaning fluid in the pressure line is dependent on whether the nozzle head is open or closed. If the nozzle head is closed, the flow rate drops and, as a result, causes the control piston to move the valve body of the overflow valve into its open position so that the cleaning fluid subject to pressure can flow to the suction line with as little flow resistance as possible. If the nozzle head is open, the flow rate in the pressure line increases and this causes the control piston to move the valve body of the overflow valve into a closed position and so the pump transfers into the normal operating state.

The control piston is displaceably held in the control chamber and divides this into a high pressure chamber and a low pressure chamber. The high pressure chamber is connected to the pressure line upstream of a flow restriction point and the low pressure chamber is connected to the pressure line downstream of the flow restriction point. An injector can, for example, be arranged in the pressure line as flow restriction point and with its aid a cleaning chemical can be mixed into the cleaning fluid subject to pressure. When a flow of fluid is present in the pressure line, the flow restriction point results in the pressure downstream of the flow restriction point differing from the pressure upstream of the flow restriction point. Since the high pressure chamber is connected to the pressure line upstream of the flow restriction point, whereas the low pressure chamber is in communication with the pressure line downstream of the flow restriction point, the control piston is acted upon with a differential pressure when a flow of fluid is present in the pressure line. On account of the differential pressure acting on it, the control piston moves the valve body of the overflow valve contrary to the direction of flow prevailing in the bypass line into a closed position, in which the valve body abuts on a valve seat of the overflow valve. If the flow of fluid in the pressure line is interrupted, the flow restriction point does not cause any drop in pressure and the pressure in the low pressure chamber corresponds to the pressure in the high pressure chamber. When a difference in pressure between the two chambers is not present, the control piston can be acted upon with a resulting force which is dependent on the areas exposed to pressure of the two chambers and as a result of which it is moved in the control chamber in such a manner that the valve body transfers into its open position. The valve body is then at a distance from the valve seat and, as a result, the flow connection between the pressure line and the suction line is released for a circular flow operation of the pump.

The control piston effects a sealed separation of the high pressure chamber from the low pressure chamber. For this purpose, a sealing element is arranged between the control piston and the control chamber. During the working operation of the pump, a considerable difference in pressure acts on the sealing element. The sealing element must reliably withstand this difference in pressure even after longer operation of the pump since a leaky separation of the low pressure chamber from the high pressure chamber in the region of the control piston can lead to impairment of the pump.

The object of the present invention is to further develop a pump of the type described at the outset in such a manner that it is less susceptible to malfunctions and more inexpensive to produce.

SUMMARY OF THE INVENTION

This object is accomplished in accordance with the invention, in a pump of the generic type, in that a sliding element which abuts sealingly on the wall of the control chamber is arranged in the control chamber and that the control piston is displaceably held in the sliding element with the interposition of the sealing element.

With the pump according to the invention, a sliding element, on which the control piston abuts slidingly and sealingly with the interposition of the sealing element, is arranged in the control chamber. The sliding element, on the other hand, abuts sealingly on the wall of the control chamber. With the aid of the sliding element, the mechanical load on the sealing element which surrounds the control piston in circumferential direction can be reduced without it being necessary for this purpose to subject the wall of the control chamber to an expensive mechanical treatment. On the contrary, the sliding element can be designed as a component which smooths the wall and along which the control piston can slide together with the sealing element surrounding it whilst maintaining the seal of the low pressure chamber relative to the high pressure chamber. The sliding element therefore forms a sealing surface, on which the sealing element can slidingly abut.

The sliding element is preferably produced from a plastic material. The wall of the control chamber can be produced, for example, from brass or from an aluminum alloy.

It is of particular advantage when the sliding element is produced from a POM (polyoxymethylene) or a PTFE (polytetrafluoroethylene) material. Materials of this type are characterized by a very low coefficient of friction and a high thermostability.

The sliding element is favorably dirt-repellent, i.e. it has only a very slight adhesion with respect to dirt particles, oil and greases. As a result, the susceptibility to malfunctioning of the pump is kept particularly low.

The sliding element can be designed, for example, in the form of a coating which covers the wall of the control chamber on the inner side.

In a particularly preferred embodiment of the invention, the sliding element is designed as a sliding sleeve which can be inserted into the control chamber. The sliding sleeve forms a component which can be handled separately and can be inserted into the control chamber during the assembly of the pump.

The sliding sleeve can bear an annular groove, in which a sealing ring is arranged, on the outer side. With the aid of the sealing ring arranged on the outer side, the sliding sleeve can abut sealingly on the wall of the control chamber.

The sliding sleeve can form a stop, for example a step which limits the area of movement of the control piston in the control chamber.

In one advantageous embodiment, the pump has a rear housing component and a front housing component which are joined together sealingly in a joining area, wherein the front housing component comprises a through passage which is aligned parallel to the pressure line and forms the control chamber and wherein the sliding element can be inserted into the through passage. The rear housing component faces a drive device for the pump, for example an electric motor. A gear and/or a swash plate and/or a piston guide can be arranged between the electric motor and the rear housing component. The front housing component is seated on the rear housing component and faces away from the drive device for the pump. The front housing component comprises a through passage aligned parallel to the pressure line. The sliding element can be inserted into the through passage in a simple manner during the assembly of the pump, i.e. the assembly costs can be kept low as a result.

The through passage favorably forms, flush with the control chamber, a portion of the bypass line which opens into a suction line section and accommodates the overflow valve. The overflow valve is thus arranged in the portion of the bypass line arranged flush with the control chamber and can be inserted into the through passage in an axial direction during the assembly of the pump in a corresponding manner to that of the sliding element. The assembly of the pump is particularly simple as a result.

It is of particular advantage when the overflow valve has a sleeve-like valve housing which forms a valve seat and can be inserted into the through passage.

The through passage favorably forms a stop of the valve housing of the overflow valve. This offers the possibility during the assembly of the pump of inserting the valve housing of the overflow valve into the through passage first of all and in a subsequent assembly step the sliding element can be inserted into the through passage and thereafter the control piston can be inserted into the sliding element. The sliding element and the sleeve-like valve housing of the overflow valve can each be aligned coaxially to the longitudinal axis of the through passage.

A pressure spring can be arranged between the valve housing of the overflow valve and the control piston and this is supported, on the one hand, on the valve housing and, on the other hand, on the control piston and acts on it with a return force once it has moved the valve body of the overflow valve into an open position.

A shaft, which is surrounded by the pressure spring and forms a guide element for the pressure spring, favorably adjoins the control piston in the direction facing the valve body of the overflow valve.

A particularly simple assembly will be achieved with one advantageous embodiment of the pump according to the invention in that the through passage extends from an end side as far as a rear side of the front housing component and the sliding element as well as the valve housing can be inserted into the through passage from the end side.

It is favorable when the through passage can be closed by means of a sealing plug at the end side following the installation of the valve housing of the overflow valve and the sliding element as well as the control piston.

A suction line section is preferably arranged in the joining area between the two housing components and the portion of the bypass line accommodating the overflow valve opens into this suction line section. The suction line section can be inexpensively produced in a simple manner prior to the two housing components being joined together. As a result, the manufacturing and assembly costs of the pump can be reduced, in addition. Moreover, the bypass line can be selected to be very short as a result of the arrangement of the suction line section in the joining area between the two housing components. This has the advantage that the flow losses of the cleaning fluid in the bypass line can be kept low. The suction line section arranged between the two housing components can have a relatively large flow cross section. As a result, the flow losses of the cleaning fluid during the circular flow operation of the pump can be reduced in addition.

The arrangement of the suction line section in the joining area between the front and the rear housing components has, in addition, the advantage that the geometric course of the suction line section is subject to less marginal conditions since the joining area is directly accessible for any machining and shaping prior to the two housing components being joined together. A curved course can, therefore, also be selected for the suction line section arranged between the two housing components when required without the production costs being substantially increased as a result. This, on the other hand, gives the constructor the possibility of optimizing the arrangement of the remaining lines and accommodating spaces of the pump with respect to as small a constructional size as possible and as sparing a use of material as possible. The course of the bypass line can, in particular, be optimized with a view to the bypass line having as low a flow resistance as possible and to the overflow valve being insertable into the bypass line in a simple manner.

The sealing of the suction line section extending between the two housing components can be brought about in an inexpensive manner by means of sealing rings which are arranged between the two housing sections.

It may be provided, in particular, for the suction line section arranged between the two housing components to extend between a first sealing ring and a second sealing ring which are positioned between the two housing components. The two sealing rings can have not only the function of sealingly closing the suction line section arranged between the two housing components but they can also undertake the additional function of sealing the joining area between the two housing components.

It is of advantage when the suction line section extending between the two housing components forms an outlet section of the suction line. The outlet section can be adjoined by at least one inlet line which accommodates an inlet valve and leads to a pump chamber. The bypass line is therefore connected to at least one inlet line which leads to a pump chamber via the suction line section arranged in the joining area between the two housing components. As a result, the flow losses of the cleaning fluid during circular flow operation of the pump can be reduced in addition.

The suction line favorably comprises an inlet section which is arranged in the front housing component and the suction line section extending in the joining area between the two housing components forms an outlet section of the suction line. The inlet section can proceed from a suction connection of the pump and, for example, be aligned transversely to the pressure line. The outlet section arranged between the two housing components can directly adjoin the inlet section.

The suction line section extending in the joining area is preferably curved in an arc shape at least in one portion thereof. The arc-shaped curvature is advantageous, in particular, with respect to the narrow spatial conditions of the pump since, as a result, the suction line section can surround spaces for accommodating the inlet and outlet valves and for the control piston and, when required, also the pressure line. A circular arc course of the suction line section arranged in the joining area has, above all, proven to be favorable.

In one particularly preferred embodiment of the pump according to the invention, the suction line section extending in the joining area is designed as a self-contained ring. With such an embodiment, an annular space can extend in the joining area between the rear housing component and the front housing component and this forms the specified suction line section. The annular space can have a relatively large flow cross section and so the cleaning fluid to be delivered can be supplied to the at least one pump chamber with little flow resistance. The cleaning fluid can be supplied to the pump chamber with little flow loss proceeding from the pump chamber via the pressure line, the bypass line and the suction line during the circular flow operation of the pump, in particular.

The front housing component of the pump has a rear-side separating surface which is placed onto a front-side separating surface of the rear housing component with the interposition of at least one sealing element. A channel, which forms at least part of the suction line section arranged in the joining area between the two housing components, is preferably integrally formed in at least one of the separating surfaces. The channel is arranged on an outer side of at least one of the housing components and can, as a result, be produced very inexpensively.

It is favorable when a channel is integrally formed in the rear-side separating surface of the front housing component, this channel being covered by the front-side separating surface of the rear housing component and forming the suction line section arranged in the joining area between the two housing components.

The suction line section extending in the joining area between the two housing components engages around the pressure line at a distance in one advantageous embodiment of the invention. It may be provided, in particular, for the suction line section extending in the joining area to surround the pressure line in a ring shape.

In one advantageous embodiment, the control piston is connected to the valve body of the overflow valve via a piston rod aligned parallel to the pressure line. A switching plunger can adjoin the valve body for the purpose of actuating a switching element and a plunger guide is preferably arranged in the opening area between the portion of the bypass line accommodating the overflow valve and the suction line section, the switching plunger slidingly abutting on the plunger guide. The opening area between the portion of the bypass line accommodating the overflow valve and the suction line section arranged in the joining area between the two housing components therefore forms a receptacle for a plunger guide, on which the switching plunger slidingly abuts. A switching element can be actuated by means of the switching plunger as a function of the position of the control piston. The control piston can, therefore, move not only the valve body of the overflow valve but also the switching plunger. The switching element which can be actuated by the switching plunger can, for example, switch a drive device of the pump, preferably an electric motor, on and off. The pump can therefore be activated and deactivated as a result of actuation of the switching plunger. If the flow of fluid in the pressure line is interrupted, the valve body of the overflow valve can transfer into its open position and the switching plunger can switch the pump off. If the flow of fluid in the pressure line is released again, the valve body of the overflow valve can take up its closed position and the pump can be switched on again by means of the switching plunger. So that the switching plunger does not tilt during its movement, it abuts slidingly on the plunger guide. This is positioned in the opening area between the bypass line and the suction line section arranged in the joining area between the two housing components for the purpose of simplifying the assembly of the pump.

The plunger guide is favorably designed as a guide sleeve which is aligned coaxially to the longitudinal axis of the through passage.

As already explained, the sliding element can be designed in the form of a sliding sleeve and the valve body of the overflow valve can be designed in the form of a valve sleeve. With such a configuration it is favorable when the sliding sleeve, the valve sleeve and also the guide sleeve are aligned coaxially to the longitudinal axis of the through passage of the front housing component since, as a result, the assembly of the pump can be carried out in a particularly simple manner.

The plunger guide is preferably arranged in the joining area between the two housing sections. It may be provided, in particular, for the plunger guide to be insertable into the through passage, which passes through the front housing component, from the rear side during the assembly of the two housing components.

The following description of a preferred embodiment of the invention serves to explain the invention in greater detail in conjunction with the drawings.

DETAILED DESCRIPTION OF THE INVENTION

Figure 3:
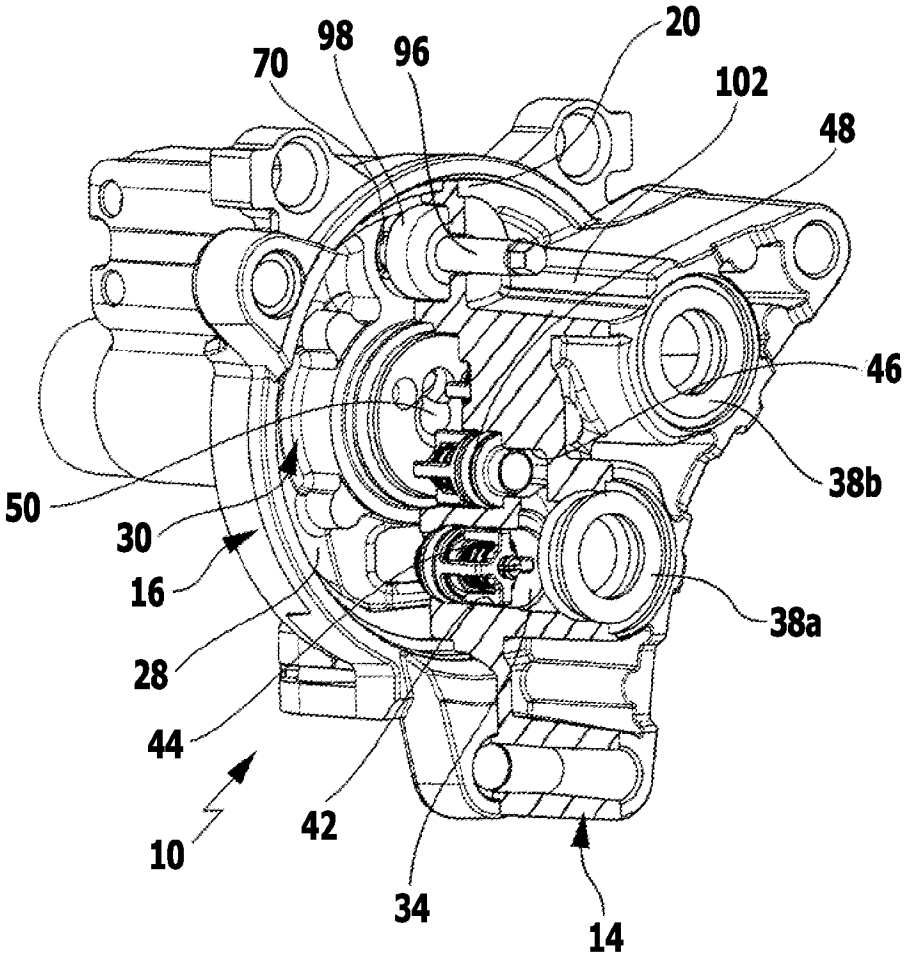
FIG. 3: shows a perspective illustration of the pump from FIG. 1 at an angle from the rear, partially cut away in a rear housing section.

A pump 10 for a high-pressure cleaning device is illustrated schematically in the drawings. The pump 10 comprises a pump housing 12 with a rear housing component 14 and a front housing component 16. The two housing components are preferably designed in the form of aluminum pressure die castings. The front housing component 16 is provided with a rear-side separating surface 20 which is placed onto a front-side separating surface 22 of the rear housing component 14 with the interposition of an outer sealing ring 24 and an inner sealing ring 26. The two sealing rings 24 and 26 are arranged concentrically to one another on the outer and the inner edge, respectively, of an annular channel 28 which is integrally formed in the rear-side separating surface 20 of the front housing component 16. The annular channel 28 is apparent, in particular, from FIG. 3. It forms an outlet section 30 of a suction line, the inlet section 32 of which is integrally formed in the front housing component 16 in the form of a blind hole.

The rear housing component 14 accommodates pump chambers 34, in each of which a cylindrical piston 36*a* and 36*b*, respectively, plunges. The pistons 36*a*, 36*b* are sealed relative to the respective pump chamber 34 by a lip-shaped annular seal 38*a* and 38*b*, respectively. Altogether, the rear housing component 14 has three pump chambers, in each of which a piston plunges. In order to achieve a better overview, only one pump chamber 34 and two pistons 36*a* and 36*b* are illustrated in the drawings. All the pistons are pushed oscillatingly into the respective pump chamber 34 by means of a swash plate which is known per se and not illustrated in the drawings and withdrawn again from the pump chamber by means of a helical spring 40 which surrounds the respective piston and so the volume of the pump chambers 34 alters periodically.

Each pump chamber 34 is in flow communication with the annular outlet section 30 of the suction line via an inlet line 42, into which an inlet valve 44 is inserted. For this purpose, the inlet line 42 opens into the front-side separating surface 22 of the rear housing component 14. This is apparent, for example, from FIG. 2.

Each pump chamber 34 is in flow communication with a pressure line 50, which extends in longitudinal direction of the pump 10 and is integrally formed in the front housing component 16, via an outlet line 46, into which an outlet valve 48 is inserted. The outlet line 46 opens, for this purpose, into the front-side separating surface 22 of the rear housing component and the pressure line 50 proceeds from the rear-side separating surface 20 of the front housing component 16 and extends as far as an end side 52 of the front housing component 16 which faces away from the rear housing component 14. The end side 52 forms the front end of the pump 10. The region between the outlet lines 46 of the pump chambers 34 and the pressure line 50 is sealed radially outwards by the inner sealing ring 26.

A central pressure valve 54 is arranged in the pressure line 50 and downstream of the pressure valve 54 the pressure line 50 accommodates a flow restriction element in the form of an injector 56. This comprises, in the customary manner, a through bore 58 which narrows first of all in flow direction and subsequently widens again and a transverse bore 60 branches off from its narrowest point.

A through passage 62, which is of a stepped design, extends through the front housing component 16 parallel to the pressure line 50 from the end side 52 as far as the rear-side separating surface 20. The end-side end region of the through passage 62 accommodates a sealing plug 64 which sealingly closes the through passage 62 at the end. In the region adjoining the sealing plug 64, the through passage 62 defines a control chamber 66 which is adjoined via a step 68 by a lower portion 70 of a bypass line which is explained in greater detail in the following. The lower portion 70 accommodates an overflow valve 72 and opens into the annular channel 28 and, therefore, into the outlet section 30 of the suction line which is arranged in the join area between the two housing components 14, 16.

The control chamber 66 is of a cylindrical design and accommodates a sliding element in the form of a sliding sleeve 74 which sealingly abuts on the wall of the control chamber 66 with the interposition of a sealing ring 76. An adjusting member in the form of a control piston 78 is held in the sliding sleeve 74 for displacement parallel to the longitudinal axis of the pressure line 50. The control piston 78 divides the control chamber 66 into a low pressure chamber 80 facing the sealing plug 64 and a high pressure chamber 82 which faces away from the sealing plug 64 and is adjoined by the lower portion 70 of the bypass line. On its outer side facing the sliding sleeve, the control piston bears a circumferential annular groove, in which a sealing element in the form of a piston sealing ring 81 is arranged.

Figure 4:
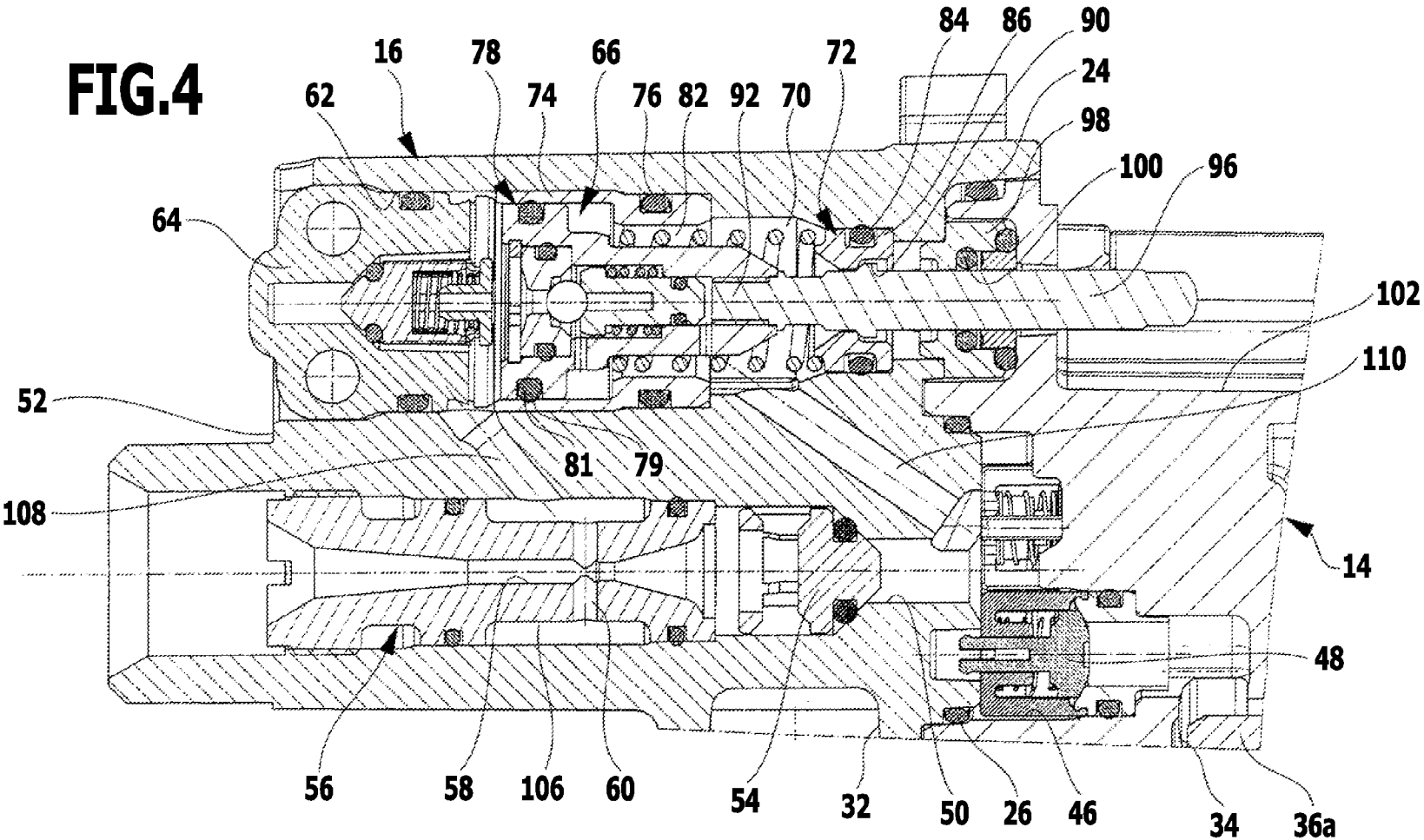
FIG. 4: shows an enlarged sectional illustration of the pump from FIG. 1 in the area of an overflow valve, the valve body of which takes up a closed position
Figure 5:
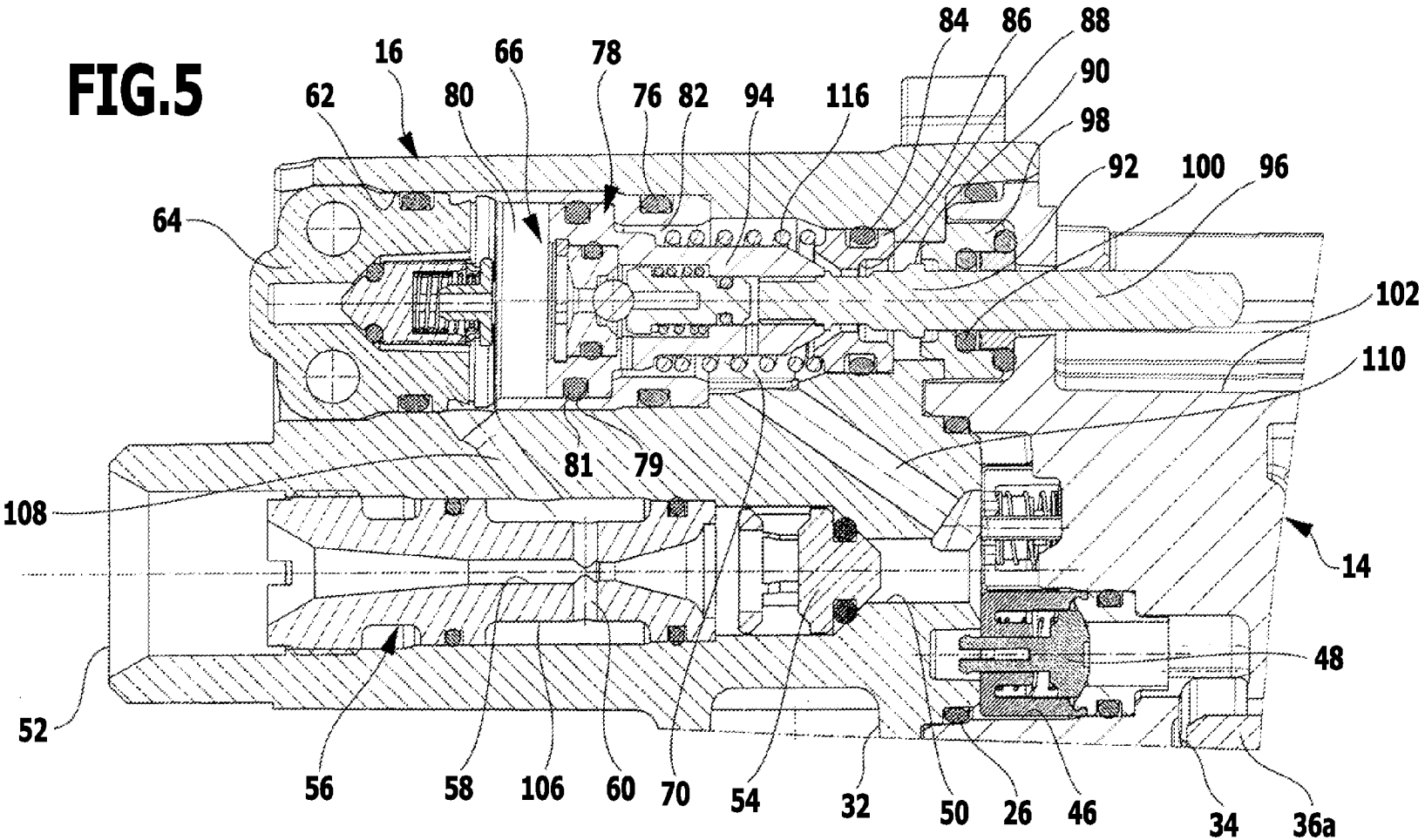
FIG. 5: shows an enlarged sectional illustration of the pump from FIG. 1 in the area of the overflow valve, wherein its valve body takes up an open position.

A valve sleeve 86, which forms a valve housing of the overflow valve 72 and comprises a valve seat 88, is inserted into the lower portion 70 of the bypass line with the interposition of a sealing ring 84. A valve body 90 of the overflow valve 72 abuts sealingly on the valve seat 88 in a closed position which is illustrated in FIG. 4. The valve body 90 is formed by a radial widening of a piston rod 92 which extends parallel to the longitudinal axis of the pressure line 50 and is connected with its end facing the sealing plug 64 to a shaft 94 which is integrally formed on the control piston 78.

On the side of the valve body 90 facing away from the shaft 94 the piston rod 92 forms a switching plunger 96 which is slidingly guided in a plunger guide in the form of a guide sleeve 98 with the interposition of a sealing ring 100. The guide sleeve 98 is flush with the valve sleeve 86 of the overflow valve 72 and arranged at a distance from it in the annular channel 28 of the rear-side separating surface 20 of the front housing component 16. The guide sleeve 98 is, therefore, positioned in the opening area between the portion 70 of the bypass line accommodating the overflow valve 72 and the outlet section 30 of the suction line.

Figure 1:
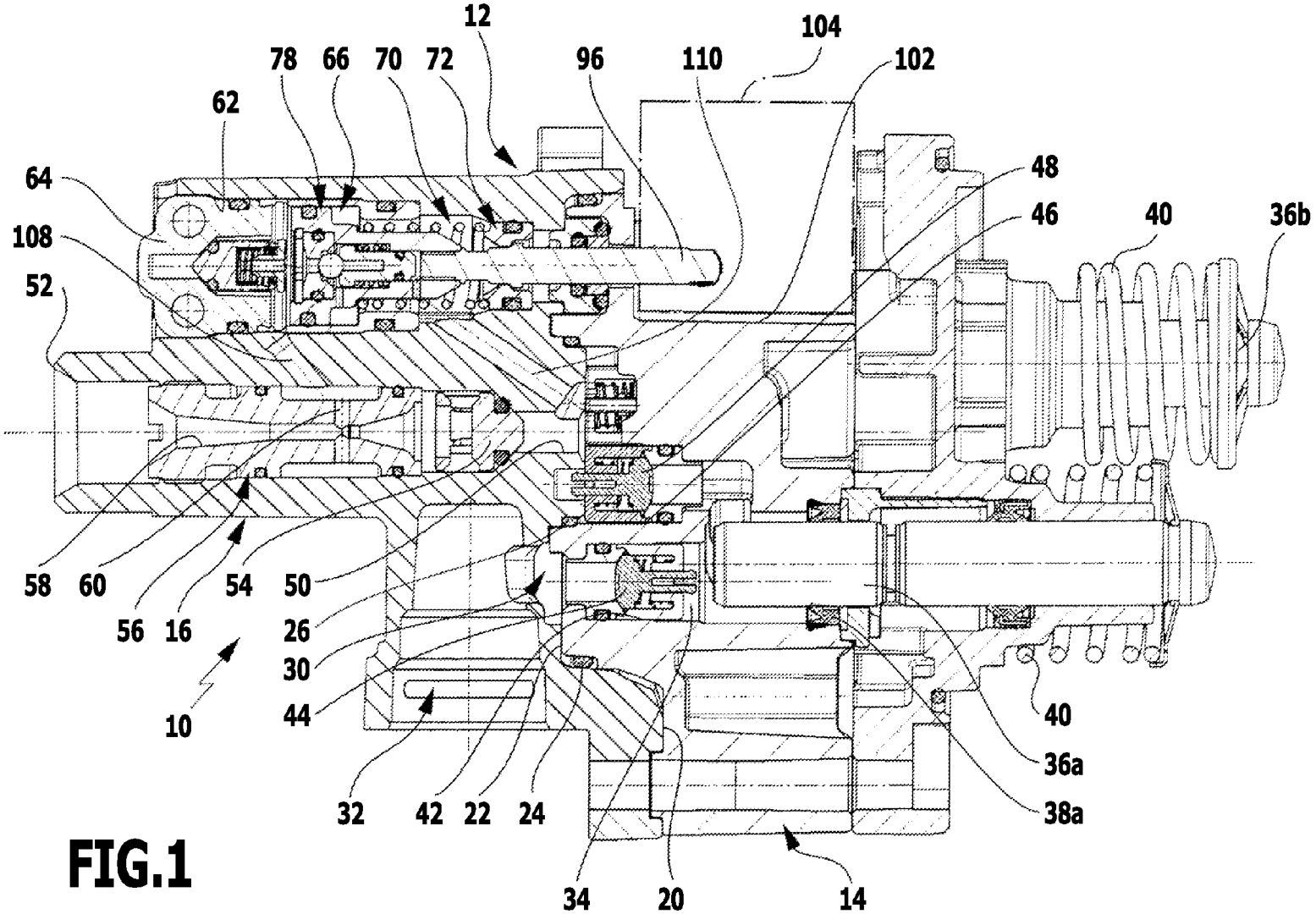
FIG. 1: shows a longitudinal section of a pump according to the invention.

The switching plunger 96 dips with its free end into a receptacle 102 which is integrally formed in the rear housing component 14 to one side and which accommodates a switching element 104 which is known per se, illustrated in FIG. 1 by a dash-dot line and can be actuated by the switching plunger 96. The switching plunger therefore passes through the joining area between the two housing components 14 and 16.

The injector 56 arranged in the pressure line 50 has on its outer side an annular groove 106, into which the transverse bore 60 opens. The annular groove 106 is adjoined by a control line 108, via which the annular groove 106 is in flow communication with the low pressure chamber 80.

Upstream of the injector 56 and the central pressure valve 54, an upper portion 110 of the bypass line extends from the pressure line 50 as far as the high pressure chamber 82. The upper portion 110 is adjoined in the through passage 62 by the lower portion 70 of the bypass line which has already been mentioned. The bypass line formed by the two portions 70 and 110 thus defines a flow connection between the pressure line 50 and the outlet section 30 of the suction line. This flow connection can be released and interrupted as a function of the position of the valve body 90 of the overflow valve 72.

Figure 2:
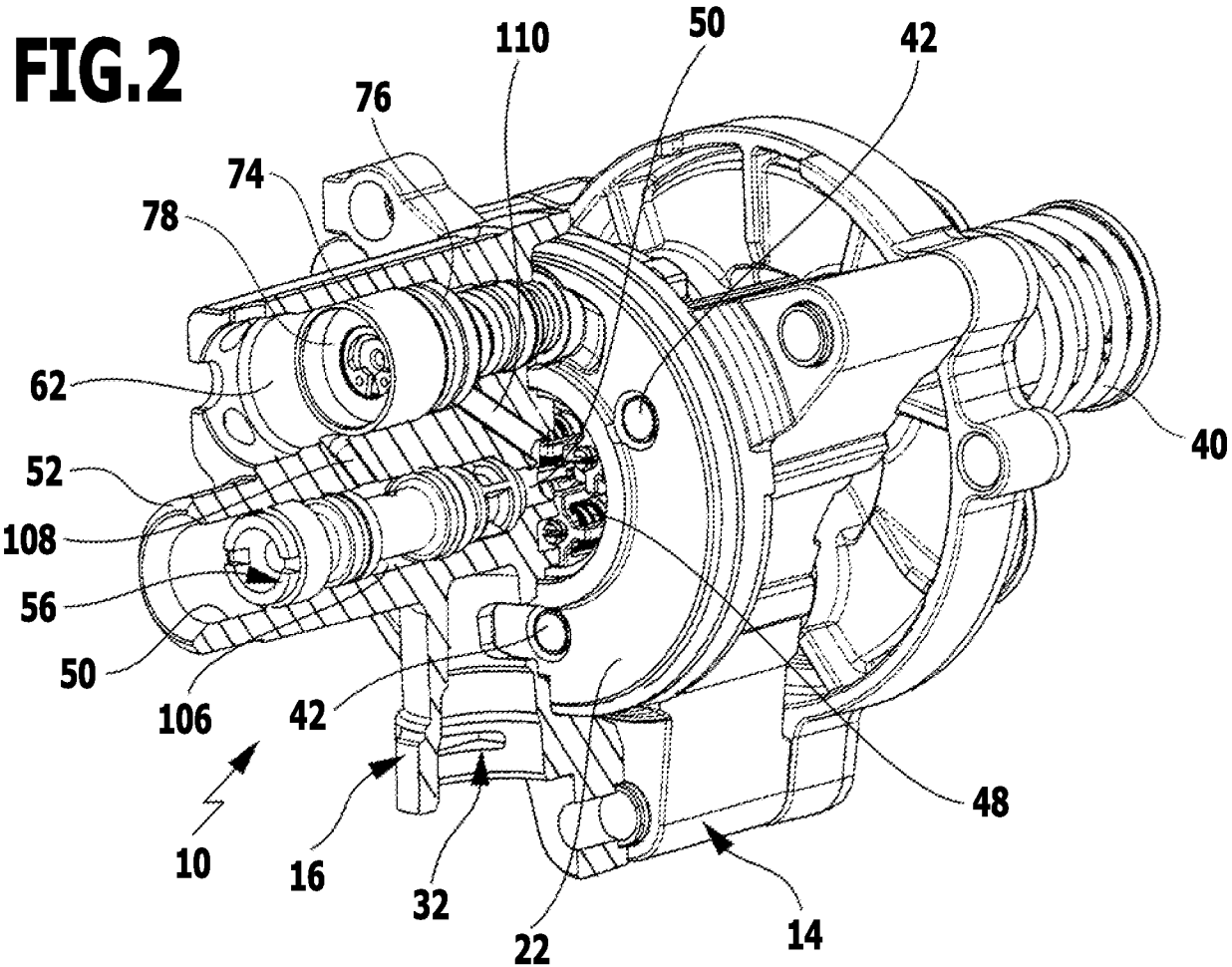
FIG. 2: shows a perspective illustration of the pump from FIG. 1 at an angle from the front, partially cut away in a front housing section.

As is apparent, in particular, from FIG. 2, the annular channel 28 and, therefore, the outlet section 30 of the suction line surrounds not only the pressure line 50 but also all the outlet lines 46 of the individual pump chambers 34 in circumferential direction. A high pressure section of the joining area between the two housing components 14 and 16, which is arranged radially centrally, is, therefore, surrounded by the annular channel and is sealed in relation to the annular channel by means of the inner sealing ring 26. The inner sealing ring 26 separates the high pressure section of the joining area, which is arranged radially centrally, from an annular low pressure section of the joining area. The low pressure section surrounds the high pressure section. It is designed in the form of the annular channel 28 and sealed radially on the outer side by means of the outer sealing ring 24.

The pump chambers 34 can be supplied with cleaning fluid to be delivered via the inlet section 32 and the outlet section 30 of the suction line and the inlet lines 42 adjoining the outlet section 30 in the joining area. The cleaning fluid will be subjected to pressure in the pump chambers 34 on account of the oscillating movement of the pistons 36 and the fluid subject to pressure will be supplied to the pressure line 50 via the outlet lines 46.

During normal operation of the pump 10, the cleaning fluid subject to pressure flows through the injector 56. This forms in the pressure line 50 a flow restriction point, at which the cleaning fluid which flows through undergoes a reduction in pressure and so the region of the pressure line 50 arranged upstream of the injector 56 has a higher pressure than the region of the pressure line at the level of the transverse bore 60 of the injector 56. As long as the pressure line 50 has cleaning fluid flowing through it, the low pressure chamber 80 which is connected to the transverse bore 60 via the control line 108 will be acted upon with a lower pressure than the high pressure chamber 82 which is connected to the entry area of the pressure line 50 via the upper portion 110 of the bypass line. As a result, the control piston 78 will be displaced in the direction of the sealing plug 64 and so the valve body 90 of the overflow valve 72 abuts sealingly on the valve seat 88 and, as a result, the flow connection between the pressure line 50 and the outlet section 30 of the suction line is interrupted. The movement of the control piston 78 in the direction of the sealing plug 64 is aided by a pressure spring 116 which surrounds the shaft 94 and abuts, on the one hand, on the control piston 78 and, on the other hand, on the valve sleeve 86.

If the flow of cleaning fluid through the pressure line 50 is interrupted, for example in that a nozzle head which is connected via a pressure hose to the pressure line 50 is closed, no dynamic pressure reduction will result in the region of the narrowing of the injector 56, the pressure in this region is, on the contrary, the same as the pressure prevailing upstream of the pressure valve 54. In this case, the same pressures result in the low pressure chamber 80 and the high pressure chamber 82 and in accordance with a suitable dimensioning of the areas exposed to pressure of the control piston 78 this will, as a result, be moved in the direction away from the sealing plug 64 contrary to the action of the pressure spring 116. Consequently, the valve body 90 lifts away from the valve seat 88 and so the overflow valve 72 releases the flow connection from the pressure line 50 via the portions 70 and 110 of the bypass line to the outlet section 30 of the suction line. As a result, the pressure prevailing in the pressure line 50 can be reduced.

The movement of the control piston 78 and the piston rod 92 connected to it also leads to actuation of the switching element 104. As a result, the drive of the pump 10 can be switched off. Any unnecessary operation of the drive when the nozzle head is closed will be avoided, as a result.

The drive will be restarted when the nozzle head is opened since, as a result, cleaning fluid can be discharged via the nozzle head so that a flow of fluid is formed in the pressure line 50. This, on the other hand, leads at the injector 56 and, therefore, also in the low pressure chamber 80 to a reduction in pressure and, consequently, to movement of the control piston 78 in the direction of the sealing plug 64. Due to the effect of the pressure ratios and due to the action of the pressure spring 116 the control piston 78 will then be moved again to such an extent in the direction facing the sealing plug that the valve member 90 takes up its closed position, in which it abuts on the valve seat 88. Moreover, as a result of the displacement of the control piston 78 the piston rod 92 and, with it, the switching plunger 96 are also displaced and so the drive of the pump 10 is switched on again by means of the switching element 104.

The movement of the control piston 78, which controls the position of the valve body 90 as well as the position of the switching plunger 96, is brought about very smoothly within the sliding sleeve 74. The latter is produced from a POM material or from a PTFE material and has a low coefficient of friction in comparison with the control piston 78 and the piston sealing ring 81 which abuts on the control piston 78 on the outer side. The piston sealing ring 81 can be moved back and forth with the control piston 78 in the sliding sleeve 74 parallel to the longitudinal axis of the pressure line 50 as a function of the flow ratios prevailing in the pressure line 50 whilst maintaining its sealing effect.

The assembly of the sliding sleeve 74, like the assembly of the valve sleeve 86, is brought about in a simple manner such that the two sleeves 74 and 86 are inserted into the through passage 62 from the end side, i.e. proceeding from the end side 52 of the front housing component 16. Subsequently, the pressure spring 116 can be inserted into the through passage, wherein the pressure spring 116 is supported on the valve sleeve 86. In a further assembly step, the control piston 78 and the shaft 94 connected in one piece to the control piston 78 can then be inserted into the through passage 62, wherein the shaft 94 takes up a position within the pressure spring 116 and in a subsequent assembly step the through passage 62 can be sealingly closed by means of the sealing plug 64. The piston rod 92 can then be inserted into the through passage 62 from the rear-side separating surface 20 and screwed into the shaft 94 and, subsequently, the guide sleeve 98 can be placed on the switching plunger 96 and inserted into the end area of the through passage 62 adjacent to the rear-side separating surface 20. The overflow valve 72 may, therefore, like the control piston 78 and the sliding sleeve 74, be mounted in the through passage 62 in a simple manner. Following successful assembly of these components, the two housing components 14 and 16 can then be joined together with the interposition of the outer and inner sealing rings 24, 26. The two housing components 14 and 16 can, for example, be screwed to one another by means of clamping screws.

The invention claimed is:

1. Pump for a high-pressure cleaning device for delivering a cleaning fluid, comprising:

at least one pump chamber, at least one piston movable back and forth plunging into said pump chamber, said pump chamber being connected to a suction line via at least one inlet valve and to a pressure line via at least one outlet valve, a bypass line leading from the pressure line to the suction line, an overflow valve arranged in said bypass line, a valve body of said overflow valve being connected to a control piston displaceably held in a control chamber and moving the valve body into a closed position or an open position as a function of a flow rate of the cleaning fluid in the pressure line, a rear housing component and a front housing component joined together sealingly in a joining area, the front housing component having a through passage aligned parallel to the pressure line and forming the control chamber, wherein:

the control piston divides the control chamber into a high pressure chamber connected to the pressure line upstream of a flow restriction point and a low pressure chamber connected to the pressure line downstream of the flow restriction point, a sliding sleeve is arranged in the control chamber and abuts sealingly on the wall of the control chamber and the control piston is displaceably held in the sliding sleeve with a sealing element interposed between the control piston and the sliding sleeve, the sliding sleeve is insertable into the through passage, the front housing component is provided with a rear-side separating surface which is placed onto a front-side separating surface of the rear housing component, the front housing component is provided with an end side which faces away from the rear housing component, the pressure line proceeds from the rear-side separating surface of the front housing component and extends as far as the end side of the front housing component, and the through passage extends through the front housing component from the end side as far as the rear-side separating surface.

2. Pump as defined in claim 1, wherein the sliding sleeve is produced from a plastic material.

3. Pump as defined in claim 1, wherein the sliding sleeve is dirt-repellent.

4. Pump as defined in claim 1, wherein the through passage forms a portion of the bypass line flush with the control chamber, said portion opening into a suction line section and accommodating the overflow valve.

5. Pump as defined in claim 4, wherein the overflow valve has a sleeve-like valve housing forming a valve seat and being insertable into the through passage.

6. Pump as defined in claim 5, wherein the sliding sleeve and the valve housing are insertable into the through passage from the end side.

7. Pump as defined in claim 4, wherein the suction line section is arranged in the joining area between the two housing components.

8. Pump as defined in claim 7, wherein the suction line section is designed as a self-contained ring.

9. Pump as defined in claim 7, wherein:

the control piston is connected to the valve body via a piston rod aligned parallel to the pressure line, a switching plunger for actuating a switching element adjoins said valve body, a plunger guide is arranged in an opening area between the portion of the bypass line accommodating the overflow valve and the suction line section, and the switching plunger abutting abuts slidingly on said guide.

10. Pump as defined in claim 9, wherein the plunger guide is designed as a guide sleeve aligned coaxially to a longitudinal axis of the through passage.

11. Pump as defined in claim 9, wherein the plunger guide is arranged in the joining area between the two housing components.

* * * * *

UNITED STATES PATENT AND TRADEMARK OFFICE

CERTIFICATE OF CORRECTION

PATENT NO. : 8,568,109 B2
APPLICATION NO. : 13/425495
DATED : October 29, 2013
INVENTOR(S) : Nathan et al.

It is certified that error appears in the above-identified patent and that said Letters Patent is hereby corrected as shown below:

In the Claims

Column 12, line 31: "the switching plunger abutting abuts slidingly on said" should read -- the switching plunger abuts slidingly on said --

Signed and Sealed this
Tenth Day of December, 2013

Margaret A. Focarino

Margaret A. Focarino
*Commissioner for Patents of the United States Patent and Trademark Office*